US009498891B2

(12) United States Patent
Tomassetti et al.

(10) Patent No.: US 9,498,891 B2
(45) Date of Patent: Nov. 22, 2016

(54) RAZOR CARTRIDGE WITH UNITARY HEATED BLADE ARRANGEMENT

(71) Applicants: Louis D. Tomassetti, Pompano Beach, FL (US); William Bohmer, Randolph, NJ (US)

(72) Inventors: Louis D. Tomassetti, Pompano Beach, FL (US); William Bohmer, Randolph, NJ (US)

(73) Assignee: HEATED BLADES HOLDING COMPANY, LLC, Pompano Beach, FL (US)

( * ) Notice: Subject to any disclaimer, the term of this patent is extended or adjusted under 35 U.S.C. 154(b) by 134 days.

(21) Appl. No.: 14/257,382

(22) Filed: Apr. 21, 2014

(65) Prior Publication Data

US 2015/0298327 A1 Oct. 22, 2015

(51) Int. Cl.

| | |
|---|---|
| ***B26B 21/48*** | (2006.01) |
| ***B26B 21/56*** | (2006.01) |
| ***B26B 21/22*** | (2006.01) |

(52) U.S. Cl.

CPC ..... *B26B 21/48* (2013.01); *B26B 21/222* (2013.01); *B26B 21/56* (2013.01); *B26B 21/565* (2013.01)

(58) Field of Classification Search

CPC ..... B26B 21/222; B26B 21/48; B26B 21/56; B26B 21/565

See application file for complete search history.

(56) References Cited

U.S. PATENT DOCUMENTS

| | | | | |
|---|---|---|---|---|
| 6,397,473 | B1 * | 6/2002 | Clark | B26B 21/227 30/50 |
| 6,877,227 | B2 * | 4/2005 | Santhagens Van Eibergen | B26B 21/227 30/34.2 |
| 7,100,284 | B2 * | 9/2006 | King | B26B 21/225 30/49 |
| 7,272,991 | B2 * | 9/2007 | Aviza | B26B 21/4068 30/50 |
| 8,327,545 | B2 * | 12/2012 | Peterson | B26B 21/565 30/346.61 |
| 8,336,212 | B2 * | 12/2012 | Bozikis | B26B 21/227 30/50 |
| 8,713,801 | B2 * | 5/2014 | Bohmer | B26B 21/48 219/50 |
| 2008/0110951 | A1 * | 5/2008 | Lauri | A45F 5/02 224/584 |
| 2009/0293281 | A1 * | 12/2009 | Bruno | B26B 21/4012 30/50 |
| 2012/0291288 | A1 * | 11/2012 | Bohmer | B26B 21/48 30/34.05 |
| 2012/0311865 | A1 * | 12/2012 | Hamilton | B26B 21/4031 30/50 |
| 2014/0245611 | A1 * | 9/2014 | Bohmer | B26B 21/48 30/34.05 |
| 2014/0266190 | A1 * | 9/2014 | Bollenbeck | G01R 33/56 324/307 |
| 2015/0135538 | A1 * | 5/2015 | Tomassetti | B26B 21/405 30/45 |
| 2015/0298326 | A1 * | 10/2015 | Tomassetti | B26B 21/222 30/34.05 |

FOREIGN PATENT DOCUMENTS

| | | |
|---|---|---|
| FR | 2 660 589 | * 10/1991 |

* cited by examiner

*Primary Examiner* — Hwei C Payer
(74) *Attorney, Agent, or Firm* — Robert M. Downey, P.A.

(57) ABSTRACT

A blade cartridge for a shaving razor includes a unitary blade arrangement as part of a heating system for a razor. The unitary blade arrangement includes one or more electrically conductive blades in electrical connection with an electric power source that may be located in the blade cartridge or in the handle of the razor, forming an electric circuit. When supplied with electric current, the blades generate heat for increased shaving performance and comfort.

6 Claims, 6 Drawing Sheets

RAZOR CARTRIDGE WITH UNITARY HEATED BLADE ARRANGEMENT

BACKGROUND OF THE INVENTION

Field of the Invention

The present invention relates to razors for shaving and, more particularly, to a razor cartridge for wet shave razors that includes a unitary heated blade arrangement.

Discussion of the Related Art

It is known that shaving comfort and overall shaving performance are improved when the user's skin is exposed to heat during the shaving process. As such, it is common practice to place the razor blades under hot running water for a period of time in order to heat the blades just prior to stroking the blades over the skin in order to cut the hairs. However, the temperature of the skin surface, hairs and blades are quickly reduced due to exposure to the ambient air. Ideally, it is best to expose the skin surface and hairs to a warm temperature throughout the shaving process to achieve better performance and increased shaving comfort.

The present invention provides a razor cartridge including a unitary heated blade arrangement having one or more blades in connection with an electric power source for electrically heating the one or more blades.

SUMMARY OF THE INVENTION

The present invention is directed to a blade cartridge for a shaving razor including a unitary blade arrangement as part of a heating system for a razor. More particularly, a unitary arrangement of one or more electrically conductive blades is in electrical connection with an electric power source to complete an electric circuit. In a preferred embodiment, the power source is a battery power source that may be located in or on the blade cartridge, or in the handle of the razor. When supplied with electric current, the blades generate heat for increased shaving performance and comfort.

OBJECTS AND ADVANTAGES OF THE INVENTION

Considering the foregoing, it is a primary object of the present invention to provide a razor cartridge with a unitary heated blade arrangement in connection with an electric power source.

It is a further object of the present invention to provide a razor cartridge with a unitary heated blade arrangement for heating a plurality of blades using a minimal quantity of parts and materials.

It is a further object of the present invention to provide a razor cartridge with a unitary heated blade arrangement including an electrically conductive blade holder.

It is still a further object of the present invention to provide a razor cartridge with a unitary heated blade arrangement for providing uniform distribution of heat throughout the blades while also ensuring the integrity of electrical contacts, thereby providing better control for maintaining optimal heated temperature of the blades.

These and other objects and advantages of the present invention are more readily apparent with reference to the following detailed description and the accompanying drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Referring to the several views of the drawings, the razor blade cartridge having a unitary heated blade arrangement of the present invention is shown and is generally indicated as 10.

Figure 1:
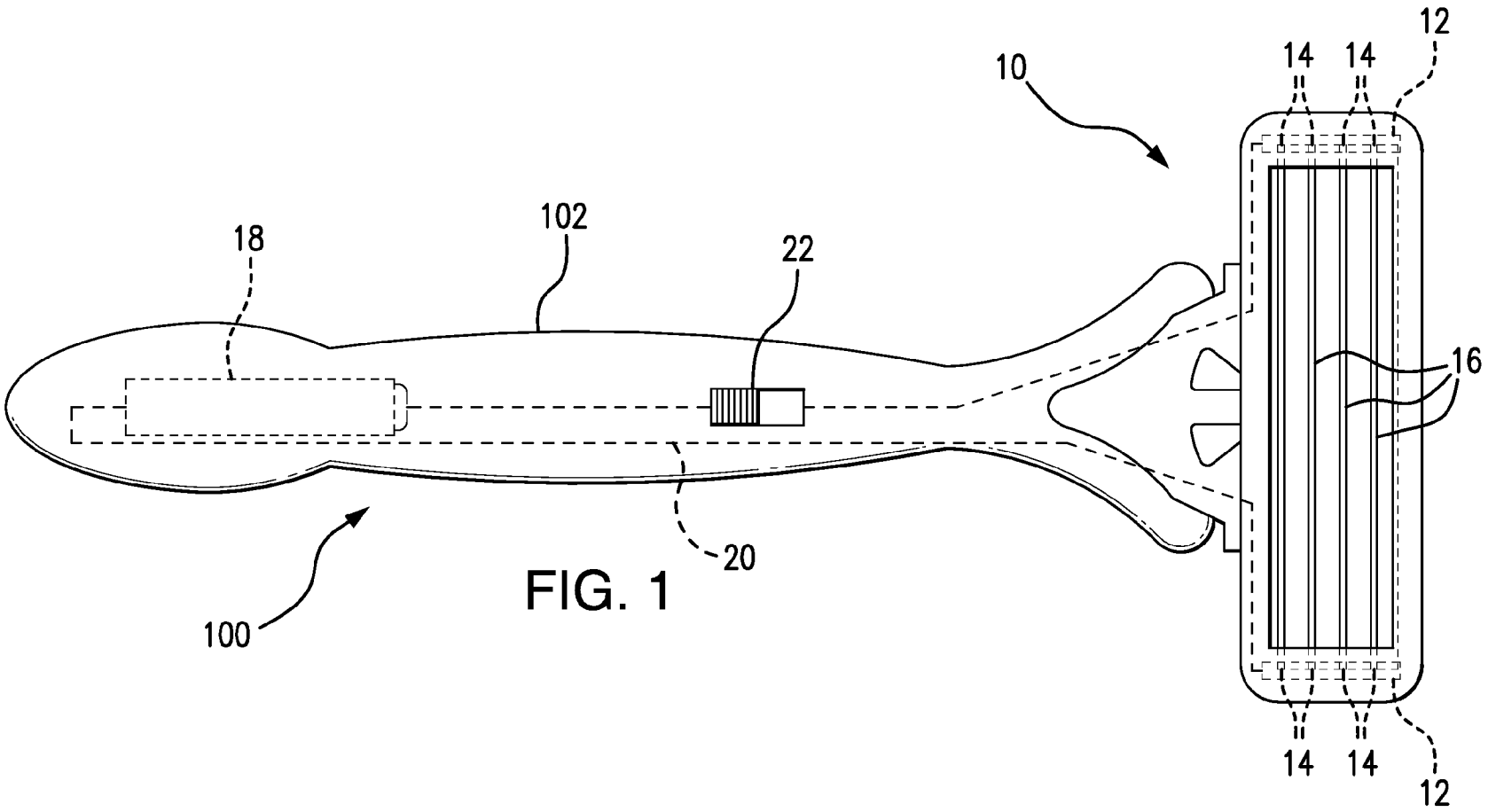
FIG. 1 is a bottom plan view illustrating the electric circuit of the razor cartridge with a unitary heated blade arrangement and electric power source.

Referring initially to FIG. 1, the razor cartridge 10 is shown in connection with a razor 100 having a handle 102. The razor cartridge 10 includes an electrically conductive blade holder 12 having a plurality of electrically conductive shelves 14, each being structured to secure one of a series of electrically conductive blades 16 as part of a unitary heated blade arrangement in connection with an electric power source 18. Each electrically conductive blade 16 includes a top side, a bottom side, a front cutting edge, a back non-cutting edge and a back surface between the back non-cutting edge and the top side. Each electrically conductive shelf 14 is configured for engaged receipt of a portion of the top side, the bottom side and the non-cutting back edge of an electrically conductive blade 16, wherein the front cutting edge of the blade 16 is exposed. The electric power source 18 may be located in the handle 102 of the razor 100, as shown in FIG. 1, or, alternatively, the electric power source 18 may be located in the razor cartridge 10. Conductive wires 20 provide for electric current flow between and through the positive and negative terminal blade holders 12, shelves 14, razor blades 16 and electric power source 18. An ON/OFF switch 22 on the handle 102 or the razor cartridge 10 is provided for activating and deactivating the blade heating system.

Figure 2:
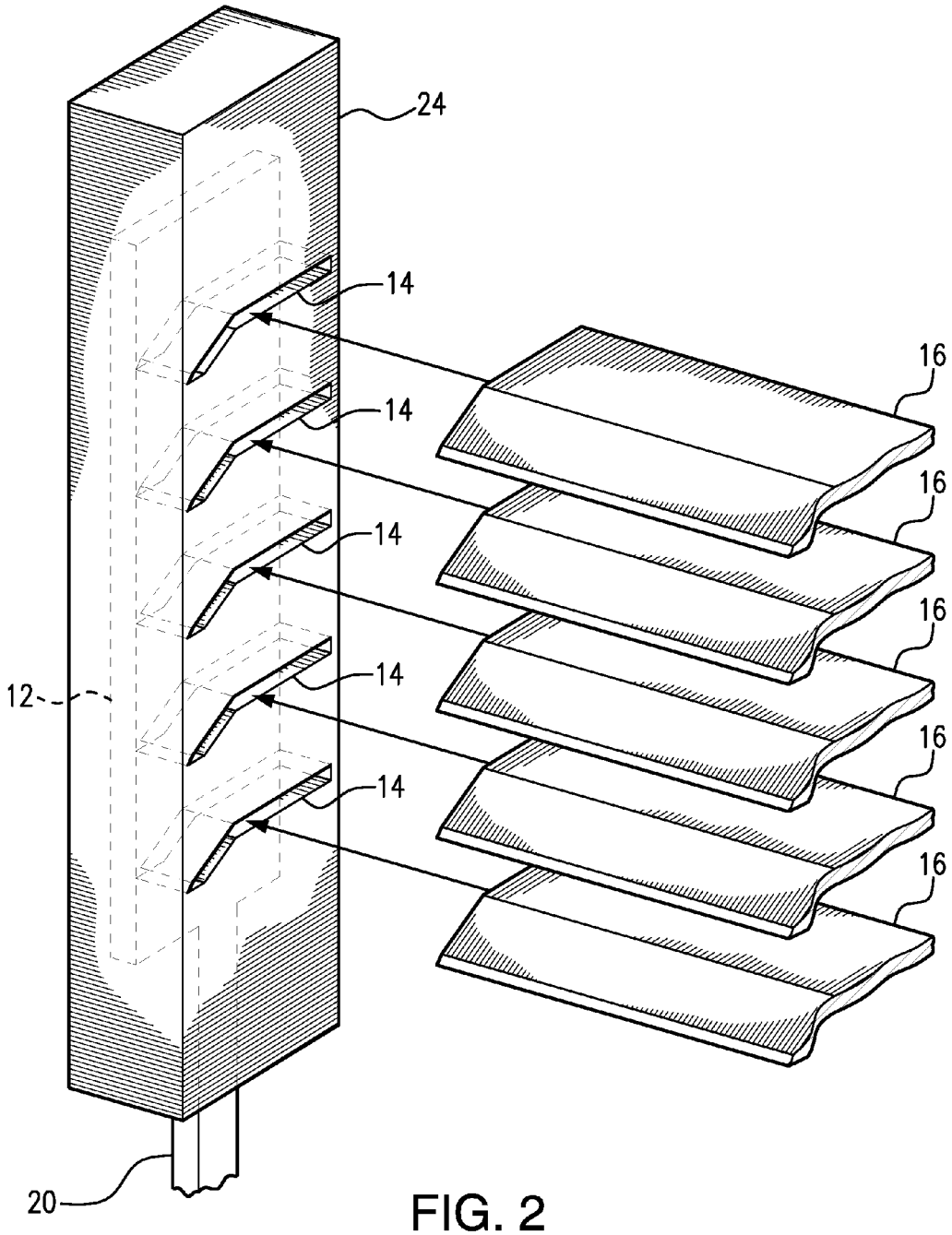
FIG. 2 is an exploded perspective view illustrating the electrically conductive blade holder and blades that, when assembled, form a unitary heated blade arrangement according to one embodiment of the present invention.
Figure 3:
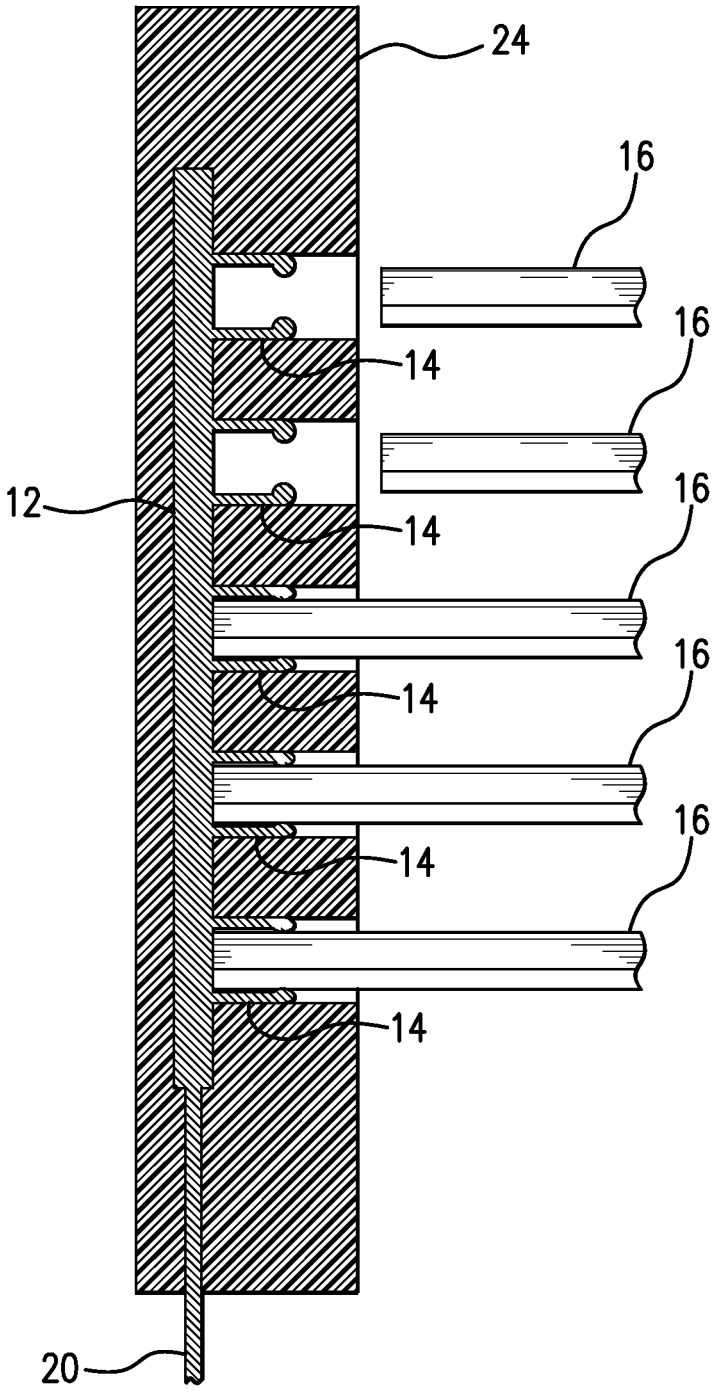
FIG. 3 is an isolated view, shown in partial cross-section, illustrating the electrically conductive blade holder and blades of the razor cartridge assembled as a unitary heated blade arrangement according to the embodiment of FIG. 2.

Referring to FIGS. 2 and 3, one embodiment of the razor cartridge 10 includes a non-conductive block 24 partially enveloping the electrically conductive blade holder 12. The non-conductive block 24 may be formed as part of the razor cartridge 10 or, alternatively, may be sized and configured to be integrally secured thereto (as shown in FIGS. 2 and 3). In a preferred embodiment, the shelves 14 and/or blade holder 12 are at least partially made from a magnetic material for magnetically attracting blades 16 to provide an enhanced and superior electrical connection of the blades 16 to the blade holder 12. While the blade holder 12 is shown to be connected to the ends of the blades 16, it is fully contemplated that the non-conductive block 24 and electrically conductive blade holder 12 can be positioned anywhere between the ends and center of the blades 16.

Figure 4:
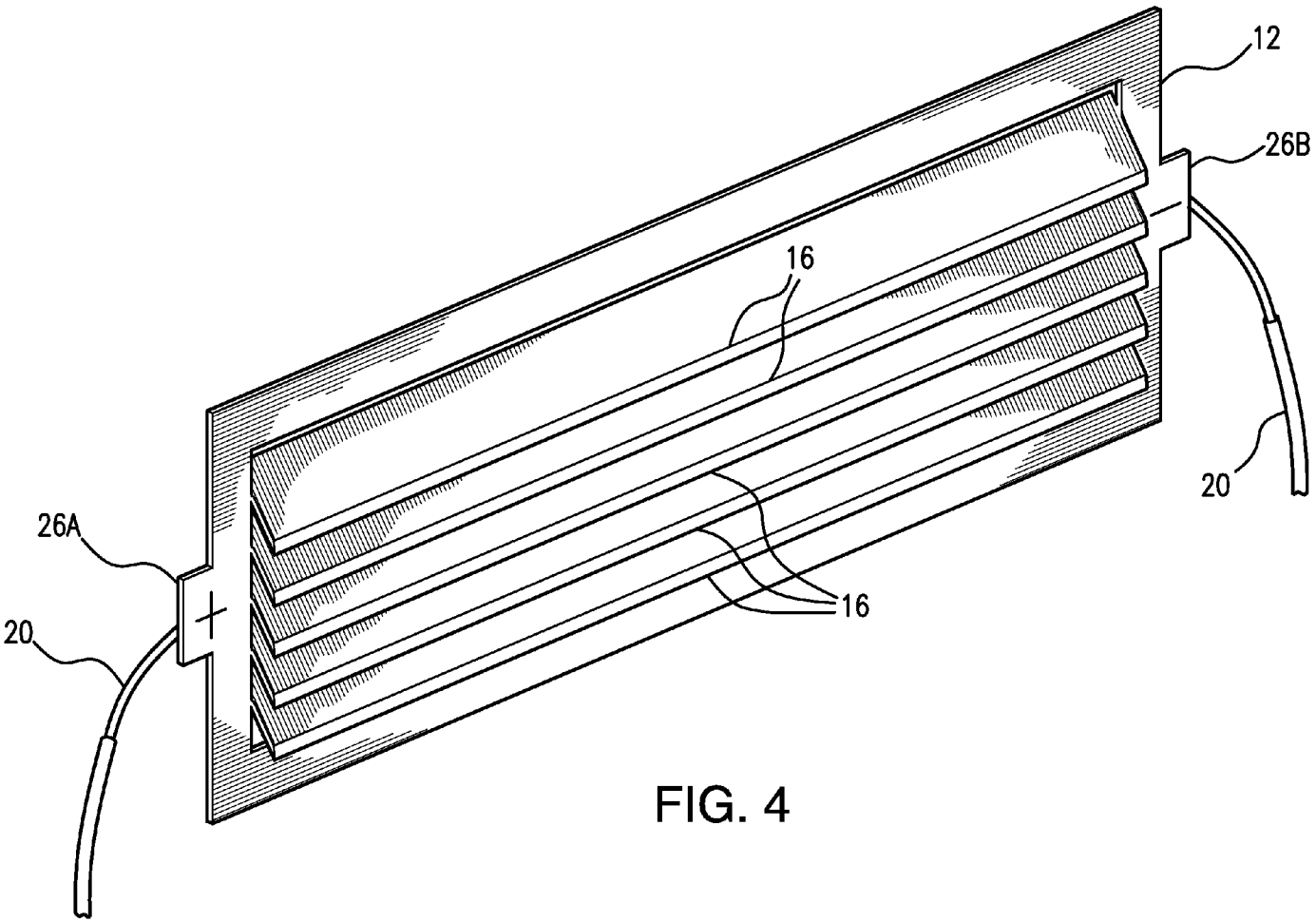
FIG. 4 is a perspective view of another embodiment of the unitary blade arrangement, wherein the blades are made by stamping, molding or forging from a single plate of electrically conductive material to form a monolithic blade body having a plurality of blades that are heated as a single unit.

Referring to FIG. 4, another embodiment of the invention provides a unitary heated blade arrangement is monolithic body, wherein the blade holder 12 and blades 16 are stamped, molded, forged or otherwise formed from a single piece (i.e., plate) of electrically conductive material. Wires 20 are in connection with each of a positive terminal 26A and negative terminal 26B for forming an electric circuit in combination with the electric power source 18. When the circuit is closed, the blades 16 are electrically heated wherein the heat is evenly distributed throughout the blades 16.

Figure 5:
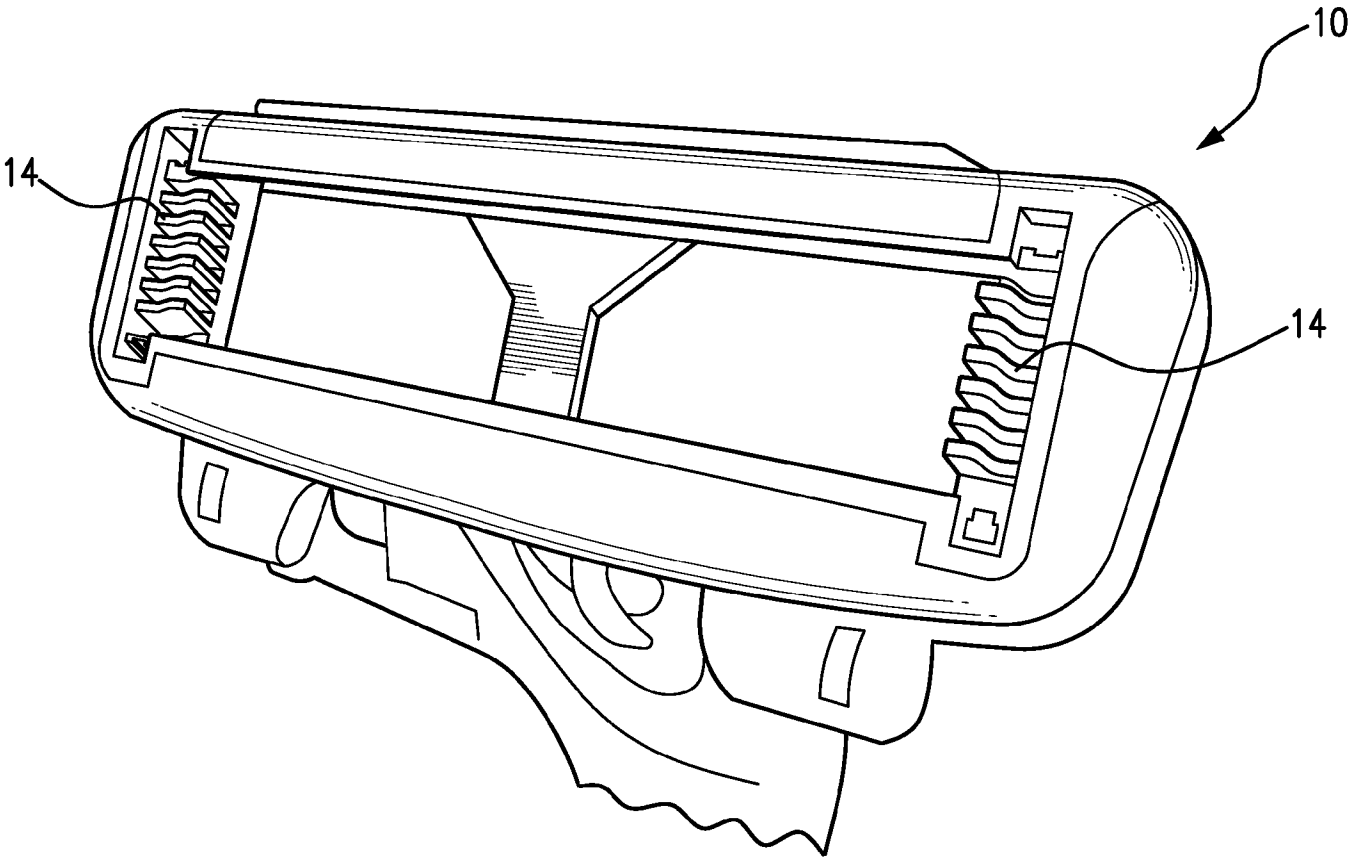
FIG. 5 is a perspective view of the razor cartridge showing the electrically conductive blade holders installed in the cartridge in accordance with the embodiment of FIG. 2.
Figure 6:
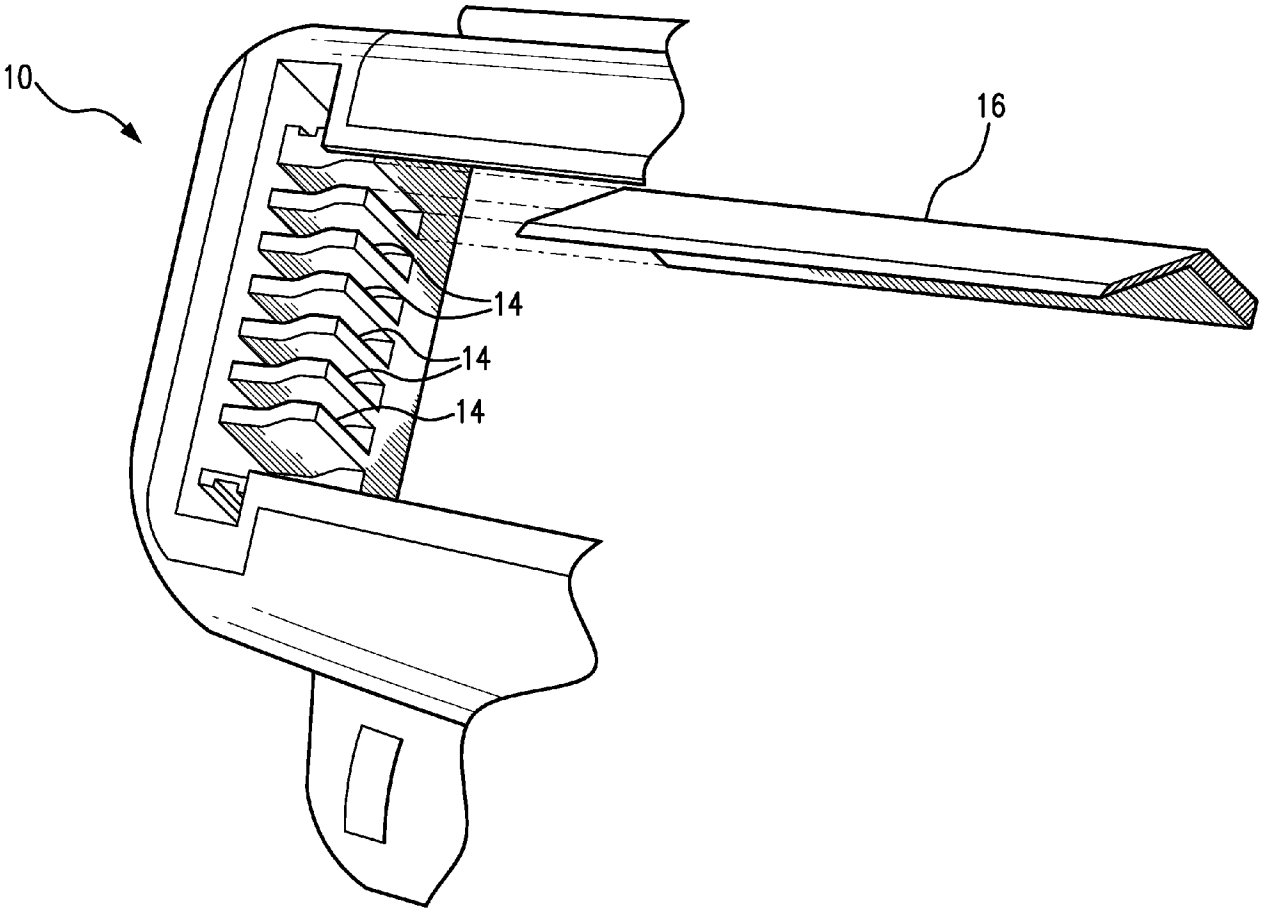
FIG. 6 is an isolated and exploded perspective view of the razor cartridge of FIG. 5 illustrating assembly of a blade with the blade holder to form the unitary heated blade arrangement.

Referring to FIGS. 5 and 6, the blade holders 12 (according to the embodiment of FIGS. 2-3) are shown installed in the razor cartridge 10. As shown in FIG. 6, the non-cutting edge portion of the blade 16 is sized for engaged receipt within one of the shelves 14, leaving the cutting edge of the blade 16 exposed. In a preferred embodiment, the shelves 14 and/or blade holders 12 are at least partially made from a magnetic material for magnetically attracting blades 16 thereto in order to facilitate securing the blades 16 in electrically conductive connection with the blade holders.

While the present invention has been shown and described in accordance with several preferred and practical embodiments, it is recognized that departures from the instant disclosure are contemplated within the spirit and scope of the present invention which are not to be limited except as defined in the following claims as interpreted under the Doctrine of Equivalents.

What is claimed is:

1. A razor cartridge forming part of a razor, said razor cartridge comprising:

a plurality of electrically conductive blades;

a first electrically conductive blade holder and a second electrically conductive blade holder each including a plurality of electrically conductive shelves, wherein each of said plurality of electrically conductive shelves is sized and configured for engaged receipt of one of said plurality of electrically conductive blades, wherein said plurality of electrically conductive blades, said first and second electrically conductive blade holders and said plurality of electrically conductive shelves form a unitary blade arrangement;

an electric power storage source for delivering electric current through said first electrically conductive blade holder, said plurality of electrically conductive blades, and said second electrically conductive blade holder, wherein flow of the electric current through said unitary blade arrangement causes said unitary blade arrangement to be heated first and second electrically conductive wires each being in connection with one of said first and second electrically conductive blade holders and said electric power storage source, and wherein the first and second electrically conductive wires are not in physical contact with the plurality of electrically conductive blades.

2. The razor cartridge as recited in claim 1 wherein said first and second electrically conductive blade holders are made from a magnetic material for magnetically attracting said plurality of electrically conductive blades.

3. The razor cartridge as recited in claim 1 wherein each of said plurality of electrically conductive shelves are is made from a magnetic material for magnetically attracting said plurality of electrically conductive blades.

4. A razor cartridge forming part of a razor, said razor cartridge comprising:

at least one electrically conductive blade being structured and disposed for receiving an electric current flow therethrough, and having a top side, a bottom side, a front cutting edge, and at least one back non-cutting edge;

a first electrically conductive blade holder and a second electrically conductive blade holder each including at least one electrically conductive shelf, wherein said at least one electrically conductive shelf is sized and configured for engaged receipt of at least a portion of the top side, the bottom side and the at least one back non-cutting edge of said at least one electrically conductive blade, wherein said at least one electrically conductive blade, said first and second electrically conductive blade holders and said electrically conductive shelves form a unitary blade arrangement;

an electric power storage source for delivering electric current through said first electrically conductive blade holder, said at least one electrically conductive blade, and said second electrically conductive blade holder, wherein flow of the electric current through said unitary blade arrangement causes said unitary blade arrangement to be heated first and second electrically conductive wires each being in connection with one of said first and second electrically conductive blade holders and said electric power storage source, and wherein the first and second electrically conductive wires are not in physical contact with the at least one electrically conductive blade.

5. The razor cartridge as recited in claim 4 wherein said first and second electrically conductive blade holders are made from a magnetic material for magnetically attracting said at least one electrically conductive blade and enhancing the electrical connection of said first and second electrically conductive blade holders to said at least one electrically conductive blade.

6. The razor cartridge as recited in claim 4 wherein each said at least one electrically conductive shelf of said first and second electrically conductive blade holders is made from a magnetic material for magnetically attracting said at least one electrically conductive blade.

* * * * *